US006154192A

United States Patent [19]

Katakura et al.

[11] Patent Number: 6,154,192

[45] Date of Patent: Nov. 28, 2000

[54] LIQUID CRYSTAL DISPLAY DEVICE AND DATA LINE DRIVE CIRCUIT OF LIQUID CRYSTAL DISPLAY DEVICE

[75] Inventors: Masayuki Katakura; Yuichi Takagi; Genichiro Ohga, all of Kanagawa, Japan

[73] Assignee: Sony Corporation, Tokyo, Japan

[21] Appl. No.: 09/063,277

[22] Filed: Apr. 21, 1998

[30] Foreign Application Priority Data

May 7, 1997 [JP] Japan ..... 9-117213

[51] Int. Cl.[7] ..... G09G 3/36

[52] U.S. Cl. ..... 345/98; 345/100

[58] Field of Search ..... 345/89, 92, 98, 345/99, 100; 349/39, 42; 327/94

[56] References Cited

U.S. PATENT DOCUMENTS 5,574,474 11/1996 Tamanoi ..... 345/100
5,623,279 4/1997 Itakura et al. ..... 345/100
5,798,747 8/1998 Moraneji ..... 345/100
5,874,934 2/1999 Ito ..... 345/100

*Primary Examiner*—Chanh Nguyen
*Attorney, Agent, or Firm*—Ronald P. Kananen; Rader, Fishman & Grauer

[57] ABSTRACT

A liquid crystal display device and a data line drive circuit of the same capable of individually reducing offsets between a video signal input and outputs, reducing a difference of offsets among outputs, and accordingly obtaining a good image quality, provided with a plurality of output blocks provided with sample-and-hold circuits connected in series for sampling the input video signal and holding the sampled data for a constant period; a drive circuit for outputting the held data of the sample-and-hold circuit as a signal of a predetermined level; and an output level adjustment circuit for comparing voltages V1 and V2 set in the switching period of the horizontal synchronization signal in the input video signal and an output signal voltage of the drive circuit and adjusting the level of the output signal of the drive circuit to a constant level.

20 Claims, 11 Drawing Sheets

LIQUID CRYSTAL DISPLAY DEVICE AND DATA LINE DRIVE CIRCUIT OF LIQUID CRYSTAL DISPLAY DEVICE

BACKGROUND OF THE INVENTION

1. Field of the Invention

The present invention relates to an improvement of a liquid crystal display device and a data line drive circuit for driving the data lines of the same.

2. Description of the Related Art

FIG. 8 is a circuit diagram of an example of the configuration of a liquid crystal display device using a thin film transistor (TFT) drive system.

As shown in FIG. 8, this liquid crystal display device 1 is constituted by a thin film transistor switch matrix portion 2. a gate line drive circuit 3, a data line drive circuit 4, a timing control circuit 5, a gate circuit 6, and a data line control circuit 7.

In the thin film transistor switch matrix portion 2, thin film transistor switches 21 are arranged in the form of a matrix.

Each thin film transistor switch 21 is constituted by thin film transistor 21*a*, a liquid crystal element 21*b*, and a counter electrode 21*c*. Further, the drain of each thin film transistor 21*a* is connected to a pixel electrode.

The gate electrodes of the thin film transistors 21*a* of the thin film transistor switches 21 arranged in the same row are connected to the same gate lines GL1 to GLM, while source electrodes of the thin film transistors 21*a* of the thin film transistor switches 21 connected in the same column are connected to the same data lines DL1 to DLN.

The gate line drive circuit 3 sequentially supplies a drive voltage to the gate lines GL1 to GLM.

The data line drive circuit 4 has n (for example n=6) number of sample-and-hold circuits, allocates the input video signal VIN to a plurality of n number of outputs at a timing controlled by a control signal CTL51 of the timing control circuit 5, and outputs n number of signals D1 to D1n at the same time at a timing where all outputs are ready.

FIG. 9 is a block diagram of an example of the configuration of the data line drive circuit 4.

As shown in FIG. 9, the data line drive circuit 4 is constituted by n number of sample-and-hold circuits 41-1 to 41-n connected in parallel to an input terminal TIN of the video signal VIN and drive circuits 42-1 to 42-n connected between outputs of the sample-and-hold circuits 41-1 to 41-n and output terminals TOUT1 to TOUTn, respectively.

In the data line drive circuit 4 of FIG. 9, switching control of a sampling time and a holding time of the sample-and-hold circuits 41-1 to 41-n is carried out based on the control signal CTL51 from the timing control circuit 5, input video signals VIN are allocated to a plurality of n number of outputs, and n number of signals D1 to D1n are output from the output terminals TOU1 to TOUTn at the same time via the drive circuits 42-1 to 42-n at a timing when all outputs are ready.

The n number of output terminals TOUT1 to TOUTn of the data line drive circuit 4 are connected in parallel to N number of data lines DL1 to DLN in units of n numbers via the thin film transistors 61-1 to 61-N (N>n) constituting the gate circuit 6.

The gate electrodes of the thin film transistor 61-1 to 61-N of the gate circuit 6 are connected to output lines of control signals CTL71 to CTL7x of the data line control circuit 7 in units of n numbers, and the thin film transistor 61-1 to 61-N are sequentially controlled to turn on in units of n numbers.

The reason why use was made of the method of driving the data lines DL in units of n numbers instead of driving the same one by one in the data line drive circuit 4 explained above was that the time allotted per dot has become shorter along with improvement of the precision of the liquid crystal display device and it has become difficult to charge (or discharge) a wiring capacitance load attached to a data line (indicated by CL in FIG. 8) and give a stable voltage within that time.

Namely, this is because if outputs of a plurality of dots (for example, n number) can be output at the same time, n times the time can be secured, so it becomes easy to give a stable voltage.

When this method is used, however, since the signals allocated to each n number of dots pass through different sample-and-hold circuits and drive circuits, an offset difference is liable to be produced among the outputs.

As the cause of the offset difference, the offset due to a droop of the sample and hold and an offset due to the driver can be considered in terms of the circuit.

This offset will be further considered by referring to FIGS. 10A and 10B and FIG. 11.

For example, if the data line drive circuit is realized by one integrated circuit (IC) as in FIG. 10A, there is a possibility of occurrence of a difference of about +50 mV due to the difference in characteristics among the elements inside the integrated circuit.

Further, if it is realized in a plurality of integrated circuits as shown in FIG. 10B, there is a possibility that a difference of about +100 mV due to the difference in characteristics among integrated circuits will be further added to this.

FIGS. 11A to 11D are views of an example of input and output of the video signal.

As shown in FIG. 11A, when assuming that the input video signal is a flat signal, ideally, as shown in FIG. 11B, the output signal must also be flat.

In actuality, however, as in FIG. 10A, the output of one IC becomes as shown in FIG. 11C, and as in FIG. 10B, the output of the plurality of integrated circuits becomes as shown in FIG. 11D (note, in FIG. 11D, m=2 in FIG. 10B).

Due to this difference in offsets among outputs, when the method of driving the data lines DL in units of n numbers instead of driving them one by one is adopted in the data line drive circuit of the related art, if this data line drive circuit is used in a high gradation liquid crystal display device, a repeating pattern of vertical stripes is generated on the screen, therefore there was the disadvantage of degradation of the image quality.

SUMMARY OF THE INVENTION

The present invention was made in consideration with such a circumstance and has as an object thereof to provide a liquid crystal display device and a data line drive circuit of a liquid crystal display device capable of individually reducing the offset between the video signal input and the outputs, reducing the difference in offsets among outputs, and further obtaining a good image quality.

To attain the above object, according to a first aspect of the present invention, there is provided a data line drive circuit of a liquid crystal display device for driving a data line to which a pixel switch is connected in accordance with an input video signal, comprising a sample-and-hold circuit for sampling the input video signal and holding the sampled data for a constant period: a drive circuit for outputting the held data of the sample-and-hold circuit as a signal of a predetermined level; and an output level adjustment circuit for comparing the voltage of a predetermined period in the input video signal with the output signal voltage of the drive circuit and adjusting the level of the output signal of the drive circuit to a constant level.

According to a second aspect of the present invention, there is provided a data line drive circuit of a liquid crystal display device for driving a plurality of data lines to which pixel switches are connected in parallel in accordance with an input video signal, comprising a plurality of output blocks provided with at least one sample-and-hold circuit for sampling the input video signal and holding the sampled data for a constant period; a drive circuit for outputting the held data of the sample-and-hold circuit as the signal of predetermined level; and an output level adjustment circuit for comparing the voltage of a predetermined period in the input video signal with the output signal voltage of the drive circuit and adjusting the level of the output signal of the drive circuit to a constant level, wherein input terminals of output blocks are connected to input terminals of the video signal in parallel and output terminals are connected to different data lines to be driven.

According to a third aspect of the present invention, there is provided a liquid crystal display having a data line drive circuit for driving a data line to which a pixel switch is connected in accordance with an input video signal, comprising a sample-and-hold circuit for sampling the input video signal and holding the sampled data for a constant period; a drive circuit for outputting the held data of said sample-and-hold circuit as a signal of a predetermined level; and an output level adjustment circuit for comparing a voltage of a predetermined period in the input video signal with the output signal voltage of said drive circuit and adjusting the level of the output signal of the drive circuit to a constant level.

According to a fourth aspect of the present invention, there is provided a liquid crystal display having a data line drive circuit for driving a plurality of data lines to which pixel switches are connected in parallel in accordance with an input video signal, comprising a plurality of output blocks provided with at least one sample-and-hold circuit for sampling the input video signal and holding the sampled data for a predetermined period, a drive circuit for outputting the held data of said sample-and-hold circuit as a signal of a predetermined level, and an output level adjustment circuit for comparing a voltage of a predetermined period in the input video signal with an output signal voltage of said drive circuit and adjusting the level of the output signal of the drive circuit to a constant level, the input terminals of output blocks being connected in parallel to an input terminal of the video signal, and the output terminals being connected to different data lines to be driven.

A comparison use voltage is set for the video signal in a predetermined period other than a video data period, and the output level adjustment circuit compares the comparison use voltage and the voltage level of the output signal of the drive circuit.

The predetermined period other than the video data period is a predetermined period within the switching period of a horizontal synchronization signal of the video signal.

The video signal is repeatedly inverted and non-inverted for every switching of the horizontal synchronization signal, and a first comparison use voltage and a second comparison use voltage are set in the switching period of both horizontal synchronization signals of the inverted period and non-inverted period, respectively.

Further, there is provided a control circuit for controlling the sample-and-hold timing of the sample-and-hold circuit of each output block and the comparison operation timing of the output level adjustment circuit.

According to the present invention, the input video signal is sampled and held at the sample-and-hold circuit, input to the drive circuit, and output to a data line as a signal of a predetermined level.

At this time, the level of the output signal of the drive circuit is compared with the voltage of a predetermined period of the input video signal in the output level adjustment circuit, and the level of the output signal of the drive circuit is adjusted to a constant level.

Further, according to the present invention, the input video signal is input to the output blocks. Then, in each output block, it is sampled and held by the sample-and-hold circuit, input to the drive circuit, and output to a data line as a signal of a predetermined level.

At this time, the level of the output signal of the drive circuit is compared with the voltage of a predetermined period of the input video signal in the output level adjustment circuit, and the level of the output signal of the drive circuit is adjusted to a constant level.

The sample-and-hold timing of the sample-and-hold circuit of each output block and the comparison operation timing of the output level adjustment circuit are controlled by the control circuit.

When the video signal is repeatedly inverted and non-inverted for every switching of horizontal synchronization signals and the first comparison use voltage and second comparison use voltage are respectively set within the switching period of both horizontal synchronization signals of the inverted period and non-inverted period, the comparison operation timing is controlled in accordance with for example the input timing of the comparison use voltage thereof.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Figure 1:
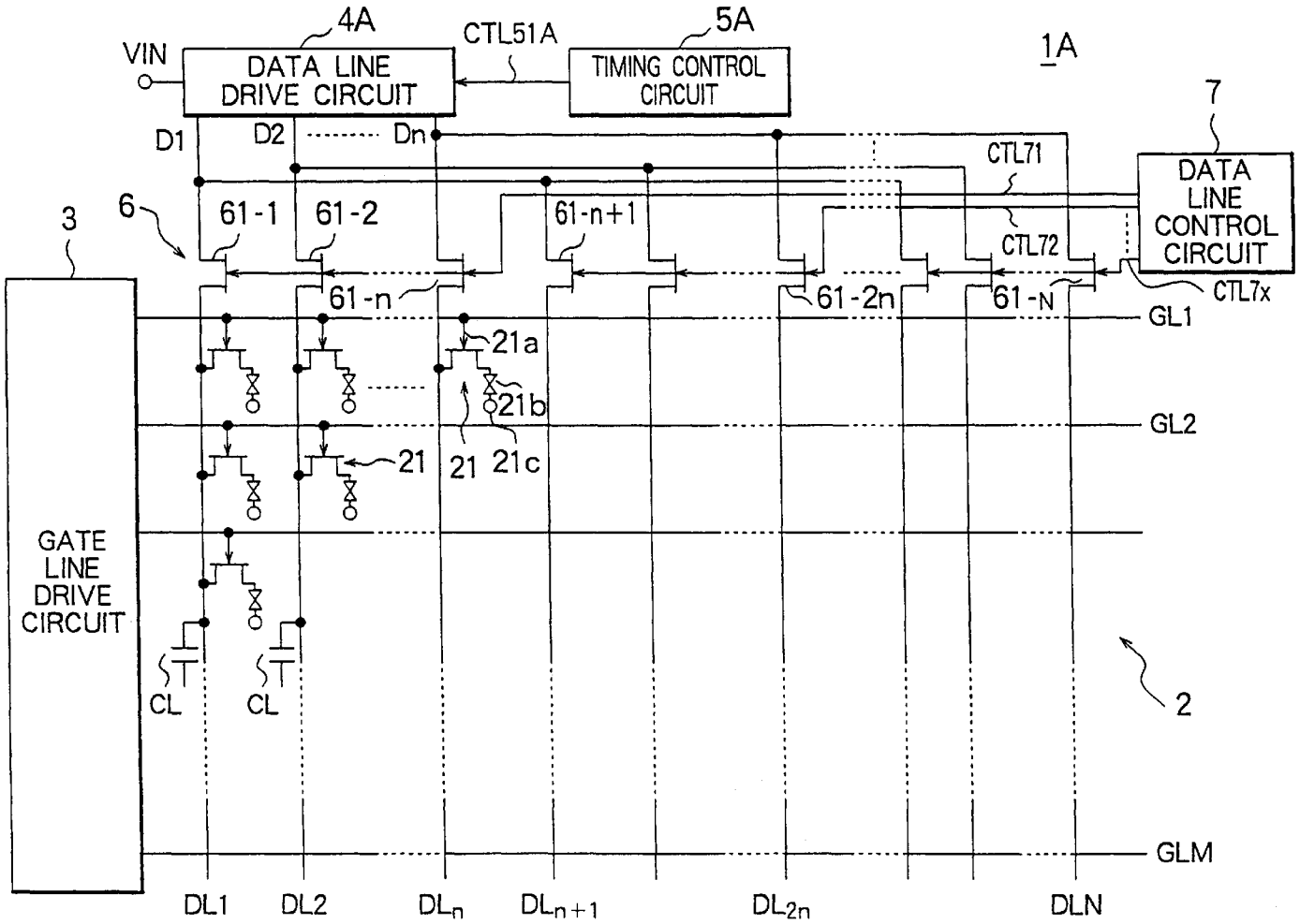
FIG. 1 is a circuit diagram of a liquid crystal display device according to an embodiment of the present invention.
Figure 2:
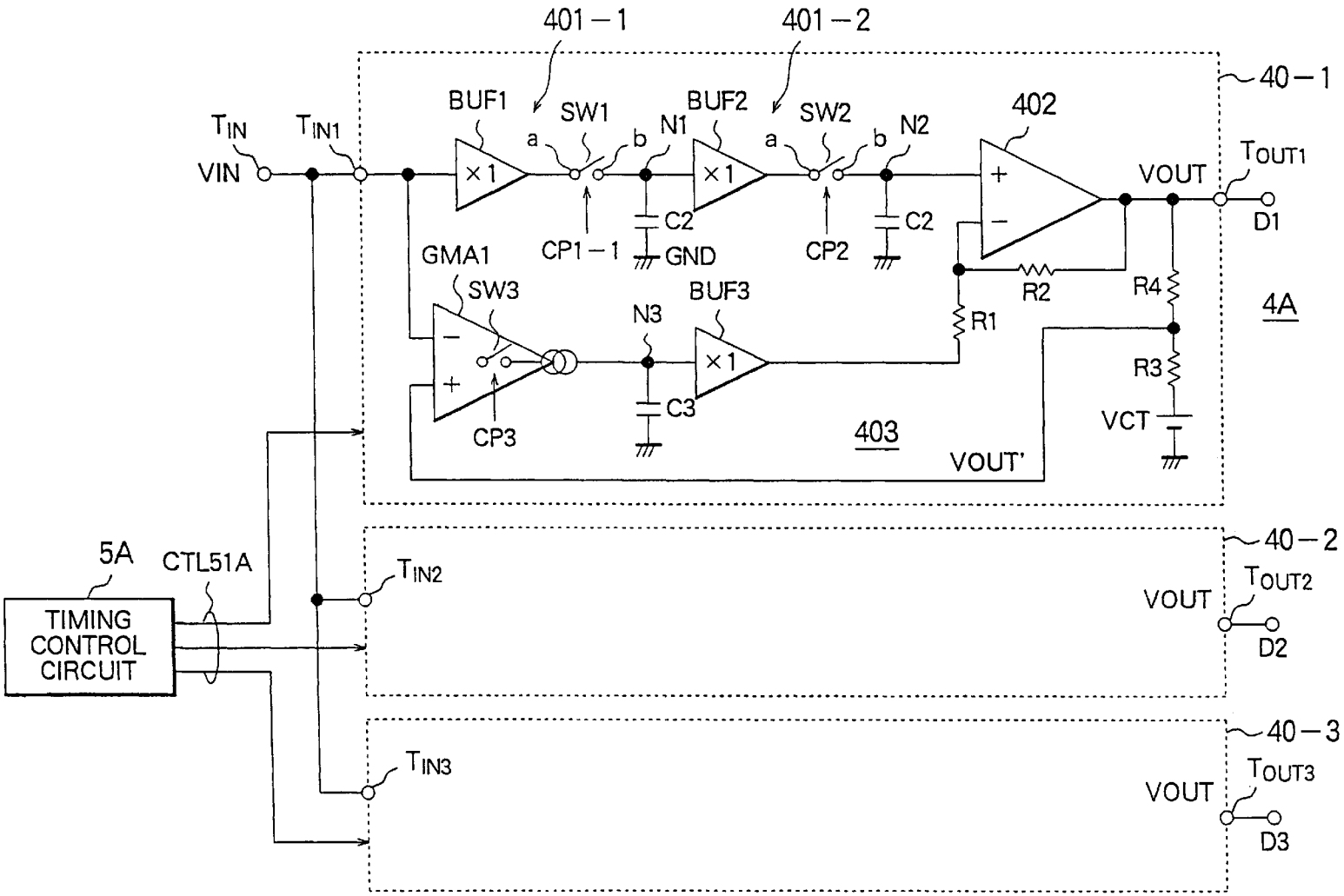
FIG. 2 is a circuit diagram of an embodiment of a data line drive circuit indicated by 4A in FIG. 1.

FIG. 1 is a circuit diagram of a liquid crystal display device according to an embodiment of the present invention; and FIG. 2 is a circuit diagram of an embodiment of the data line drive circuit indicated by 4A in FIG. 1.

Figure 8:
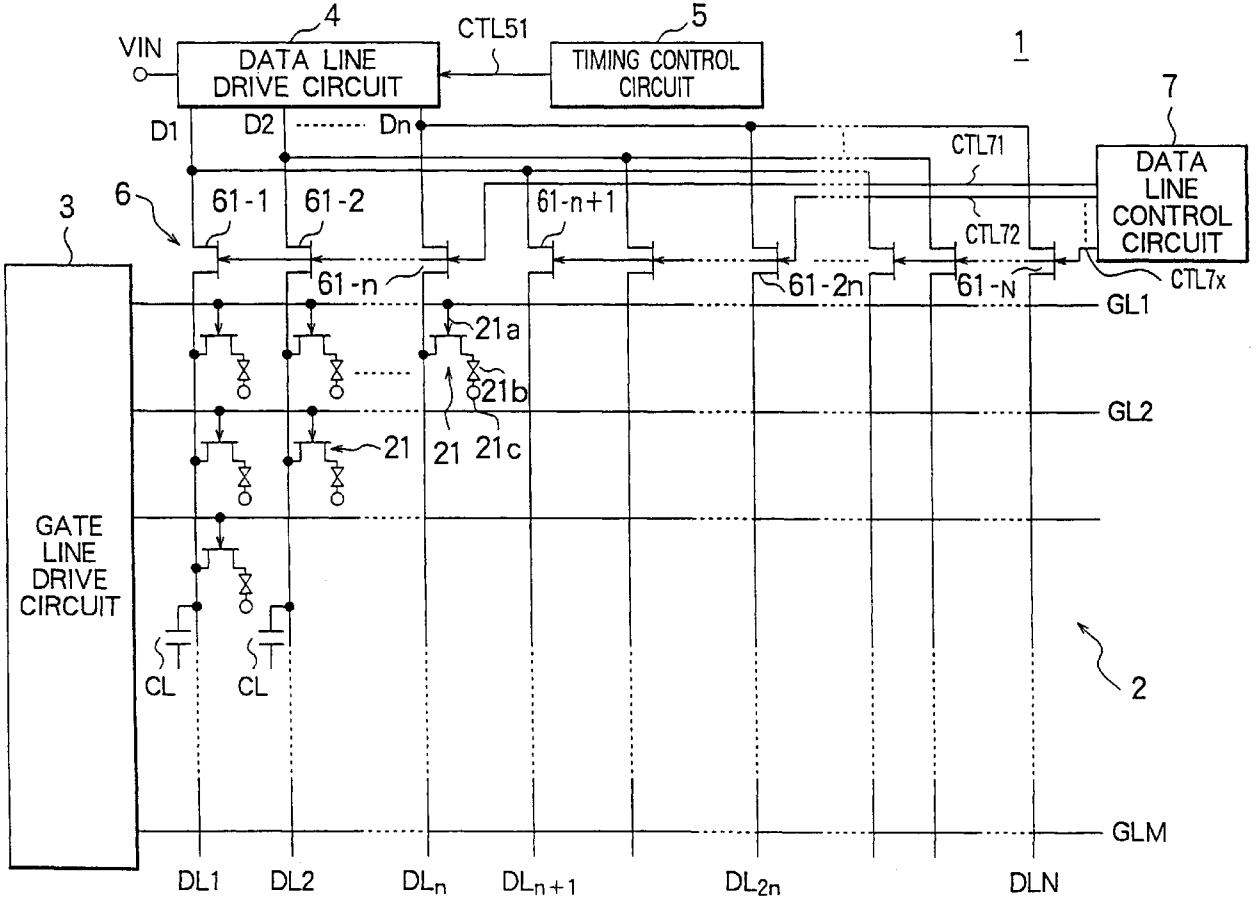
PRIOR ART FIG. 8
FIG. 8 is a circuit diagram of an example of the configuration of a liquid crystal display device using a thin film transistor drive method.
Figure 9:
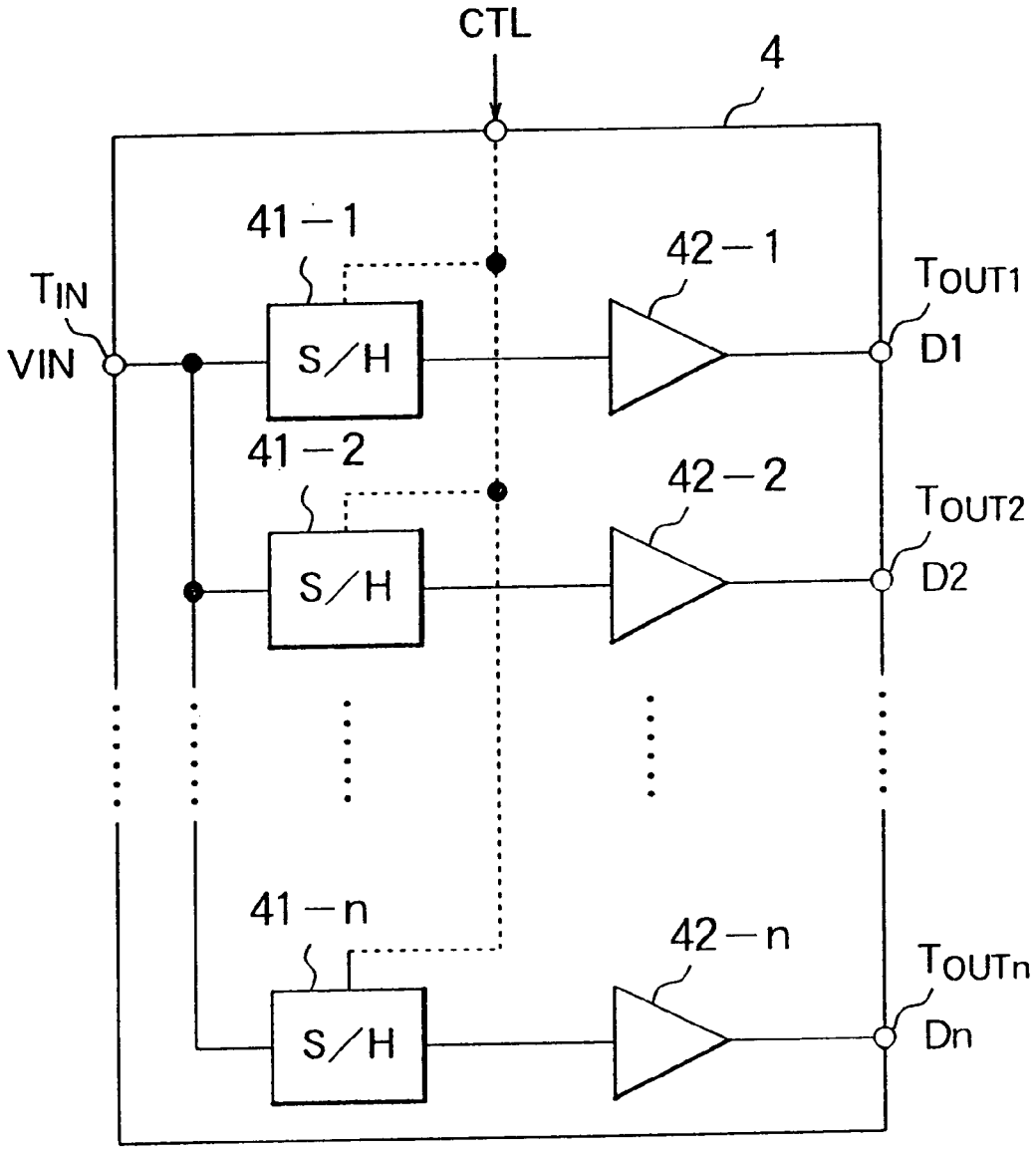
PRIOR ART FIG. 9
FIG. 9 is a block diagram of an example of the configuration of a data line drive circuit of the related art.

The present liquid crystal display device 1A uses a thin film transistor drive method similar to the device of FIG. 8 and is constituted by a thin film transistor switch matrix portion 2 in which thin film transistor switches are arranged in the form of a matrix, a gate line drive circuit 3 for sequentially supplying a drive voltage to the gate lines GL1 to GLM, a data line drive circuit 4A, a timing control circuit 5A, a gate circuit 6, and a data line control circuit 7. These constituent elements are provided in the liquid crystal display device 1A with a connection configuration similar to that of the circuit configuration of FIG. 8.

Note that, each thin film transistor switch 21 in the thin film transistor switch matrix portion 2 is constituted by a thin film transistor 21*a*, a liquid crystal element 21*b*, and a counter electrode 21*c*. The drain of each thin film transistor 21*a* is connected to a pixel electrode. The gate electrodes of the thin film transistors 21*a* of the thin film transistor switches 21 arranged in the same row are connected to the gate lines GL1 to GLM, while the source electrodes of the thin film transistors 21*a* of the thin film transistor switches 21 arranged in the same column are connected to the same data lines DL1 to DLN.

Figure 3:
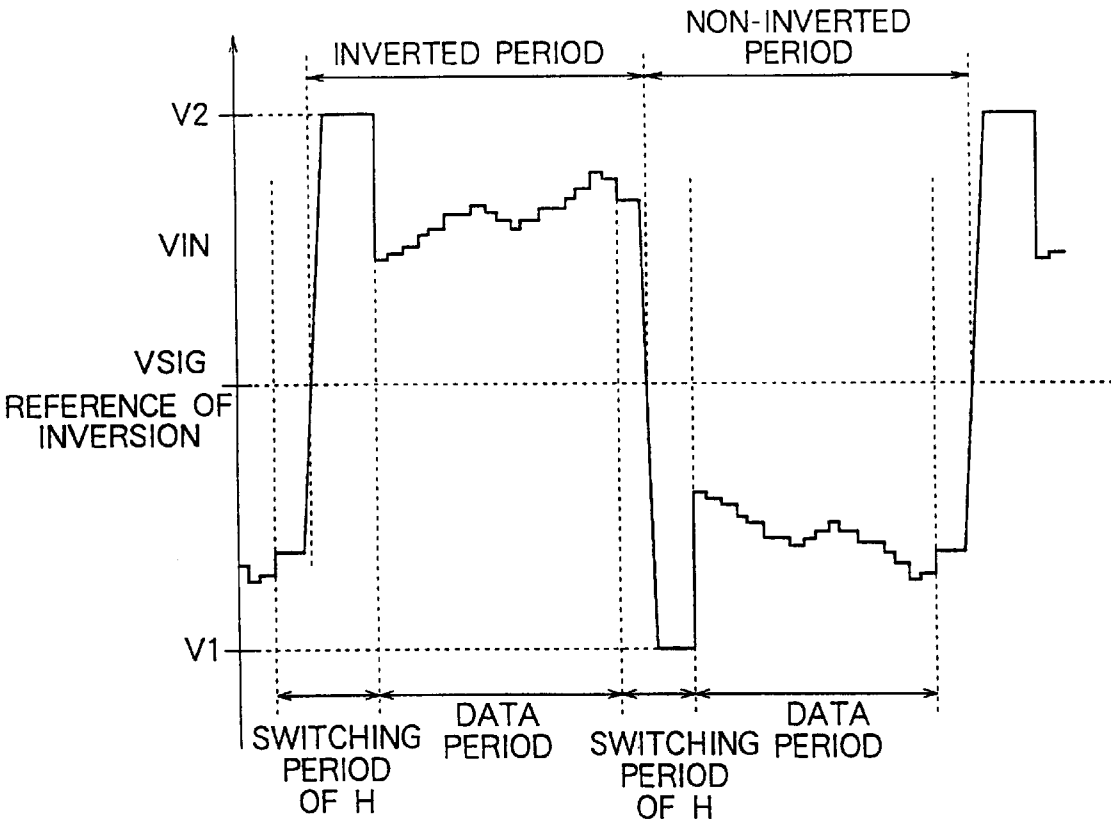
FIG. 3 is a view for explaining an example of the configuration of a video signal according to the present invention and inverting and non-inverting operations.

Further, the video signal in the present embodiment is repeatedly inverted and non-inverted for every switching of the horizontal synchronization signal (H) as shown in FIG. 3. A first comparison use voltage V1 and second comparison use voltage V2 are set within the switching period of both horizontal synchronization signals of the inverted period and non-inverted period.

As shown in FIG. 2, in the present data line drive circuit 4A, output blocks 40-1 to 40-n corresponding to n number of outputs (n=3 in the present embodiment) are connected to the input terminal TIN of the video signal VIN in parallel.

Note that, in FIG. 2, for simplification of explanation, the number n of blocks to which the input video signal VIN is supplied is set to "3". The circuit configuration is the same in the output blocks 40-1 to 40-3, so the detailed configuration is shown for only the output block 40-1.

The output block 40-1 is constituted by first and second sample-and-hold circuits (S/H) 401-1 and 401-2 connected in series, a drive circuit 402, and an output level adjustment circuit 403.

The first sample-and-hold circuit 40-1 is constituted by a buffer circuit BUF1, a switch circuit SW1, and a capacitor C1.

The input of the buffer circuit BUF1 is connected to an input terminal TIN1 of the video signal VIN, while the output terminal is connected to a fixed contact a of the switch circuit SW1. An operation contact b of the switch circuit SW1 is connected to one electrode of a capacitor C1 (the point of connection of them will be defined as an output node N1), and the other electrode of the capacitor C1 is grounded.

The switch circuit SW1 maintains an off state when a pulse-like control signal CP1-1 of the timing control circuit 5A is at low level and becomes an on state when it is at a high level.

The first sample-and-hold circuit 401-1 is in the sampling time when the switch circuit SW1 is in the on state. At this time, the capacitor C1 is charged to a voltage equal to the output voltage of the buffer circuit BUF1.

It enters the holding time and holds the charged voltage when the control signal CP1-1 becomes a low level and it is in the off state.

The second sample-and-hold circuit 401-2 is constituted by a buffer circuit BUF2, a switch circuit SW2, and a capacitor C2.

The input of the buffer circuit BUF2 is connected to the output node N1 of the first sample-and-hold circuit 401-1, while the output terminal is connected to the fixed contact a of the switch circuit SW2. The operation contact b of the switch circuit SW2 is connected to one electrode of the capacitor C2 (the connection point of the two being defined as an output node N2), and the other electrode of the capacitor C2 is grounded.

The switch circuit SW2 maintains the off state when the pulse-like control signal CP2 of the timing control circuit 5A is at a low level and becomes an on state when it is at a high level.

The second sample-and-hold circuit 401-2 is in the sampling time when the switch circuit SW2 is in the ON state. At this time, the capacitor C2 is charged to a voltage equal to the output voltage of the buffer circuit BUF2.

It enters the holding time and holds the charged voltage when the control signal CP2 becomes a low level and it is in the off state.

The drive circuit 402 holds the output signal of the second sample-and-hold circuit 401-2 at a predetermined level VOUT under the control of the output level adjustment circuit 403 mentioned later and outputs a signal D1 from an output terminal TOUT1.

The non-inverting input terminal (+) of the drive circuit 402 is connected to the output node N2 of the second sample-and-hold circuit 401-2, and the inverting input terminal (−) is connected to the output terminal via a resistor element R2 and, at the same time, connected to the output of the output level adjustment circuit 403.

The output level adjustment circuit 403 compares the input video signal VIN with a voltage VOUT' obtained by resistance-division of the level of the output signal VOUT of the drive circuit 402 and supplies the signal in accordance with the difference to the inverting input terminal (−) of the drive circuit 402 in a direction cancelling the difference between the video signal VIN and the feedback voltage VOUT'.

The output level adjustment circuit 403 is specifically constituted by a voltage/current conversion amplifier GMA1, capacitor C3, buffer circuit BUF3, resistor elements R1 to R4, and a constant voltage source VCT.

The inverting input terminal (−) of the voltage/current conversion circuit GMA1 is connected to the input terminal TIN1 of the video signal VIN, the non-inverting input terminal (+) is connected to the connection point of the resistor elements R3 and R4, and the output terminal is connected to one electrode of the capacitor C3 and the input terminal of the buffer circuit BUF3 (the connection point of the two being defined as an output node N3). The other electrode of the capacitor C3 is grounded, and the output terminal of the buffer circuit BUF3 is connected to the inverting input terminal (−) of the drive circuit 402 via the resistor element R1.

The resistor elements R4 and R3 and the constant voltage source VCT are connected in series between the output terminal of the drive circuit 402 and the ground line.

In the output level adjustment circuit 403, the voltage/current conversion circuit GMA1 has a switch circuit SW3 controlled to the on or off state by a control signal CP3 of the timing control circuit 5A. When the switch circuit SW3 is in the on state, the voltage level of the input video signal VIN and the resistance-divided voltage VOUT' are compared.

Then, the difference of the two voltages is output as current and converted to voltage at the capacitor C3. Then, the voltage of the node N3 passes through the buffer circuit BUF3 and is supplied to the inverting input terminal (−) side of the drive circuit 402 in a direction cancelling the difference of VIN and VOUT'.

Note that, in the output level adjustment circuit 403, the resistor elements R1 and R2 are provided for supplying an amount of correction.

Further, the resistor elements R3 and R4 are provided so as to divide VOUT to R3/(R3+R4) to obtain a VOUT' equal to VIN since the output signal voltage VOUT of the drive circuit 402 becomes (R1+R2)/R1 with respect to the input video signal VIN when voltages are compared at the voltage/current conversion circuit GMA1 and the comparison is difficult as is.

Accordingly, desirably a relationship of R2/R1=R4/R3 is satisfied.

Further, a supply voltage of the constant voltage source VCT is suitably defined as the center voltage of the input voltage range.

By constituting this loop, finally, the output signal voltage VOUT of the drive circuit 402 becomes stable at a value in which the offset is suppressed with respect to the input video signal VIN.

Further, the voltage comparison in the voltage/current conversion circuit GMA1 of the output level adjustment circuit 403 is carried out at both of a time of inversion and a time of non-inversion of the video signal VIN.

This will be mentioned in detail below.

When a DC-like voltage is continuously supplied to the liquid crystal display, the service life thereof is shortened, therefore a method in which the video signal VIN is inverted about a reference voltage VSIG (for example 7V) for every horizontal synchronization signal (H) and averaged to prevent the DC-like voltage from being supplied is used as relatively principal method.

FIG. 3 shows the situation of the video signal at this time.

In the case of the input of the video signal as shown in FIG. 3, even if the comparison operation for improvement of the offset is carried out only at the time of non-inversion or the time of inversion, the advantageous effect thereof can be obtained.

In this case, however, if there is a fine gain difference between input and output, the following may occur.

Figure 4:
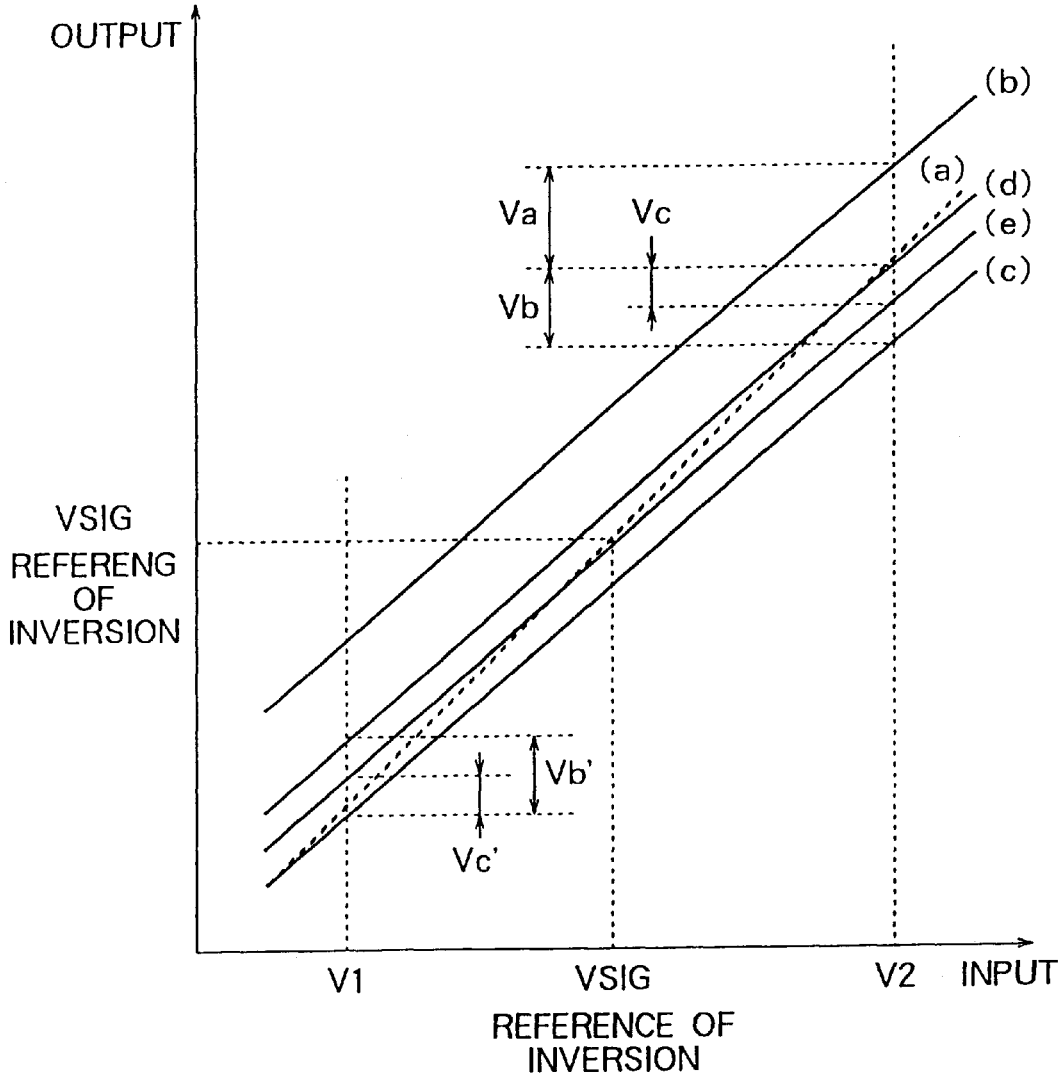
FIG. 4 is a view for explaining an input/output characteristic of a data line drive circuit.
Figures 5A, 5B, 5C, 5D, 5E, 5F:
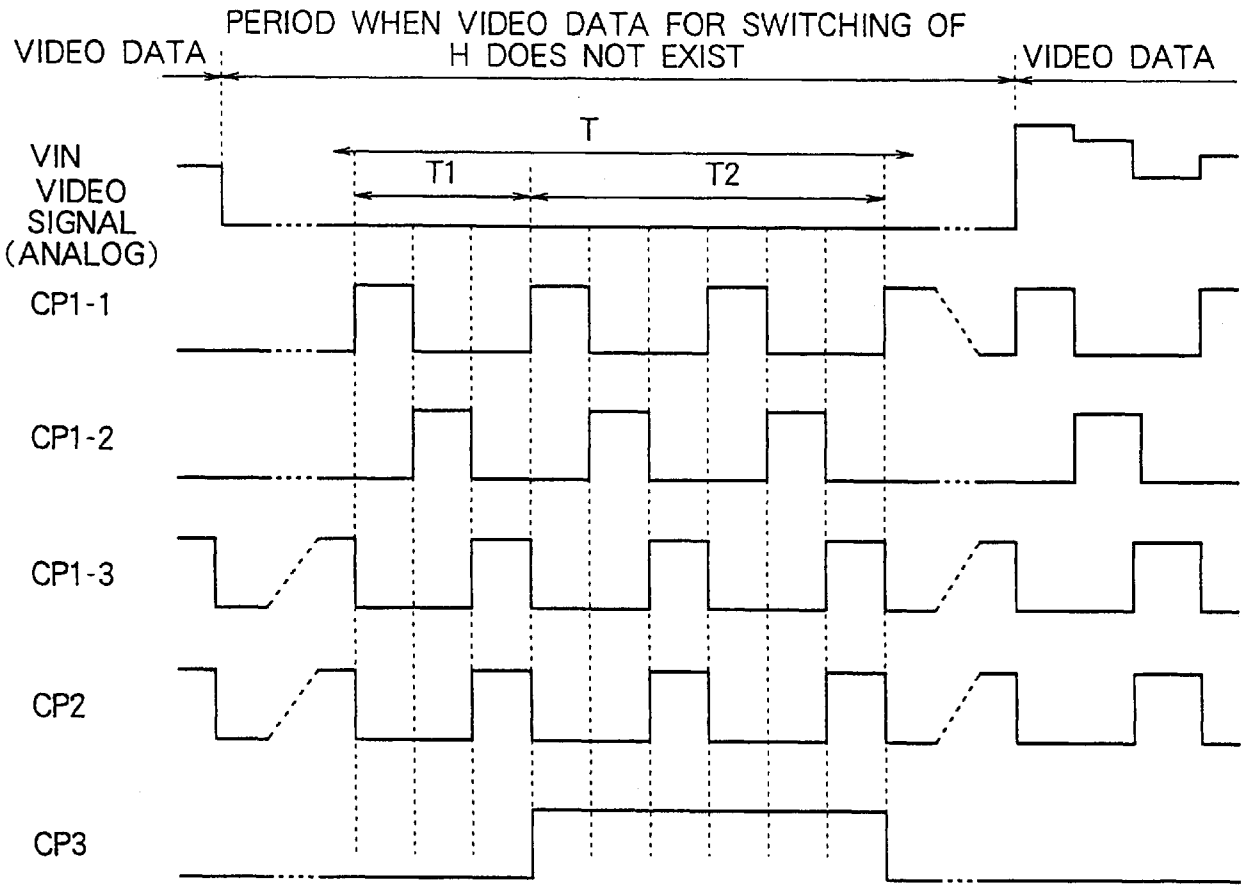
FIGS. 5A to 5F are timing charts for explaining the timing control of the sample-and-hold operation and comparison operation by a timing control circuit according to the present invention.

FIG. 4 is a view for explaining the input/output characteristic of the data line drive circuit.

In FIG. 4, a straight line indicated by a broken line of (a) is the ideal input/output characteristic,.

Contrary to this, a straight line (b) shown in FIG. 4 is an example of the input/output characteristic when the process of dealing with the offset by the comparison of input and output by the present invention is not carried out.

It is assumed that the characteristic indicated by (b) has also a fine gain difference other than the offset.

Here, the characteristic when the process of dealing with the offset by the comparison of the input and output according to the present invention is carried out only at a time of non-inversion (at a point V1: for example 3V) is indicated by a straight line (c) in FIG. 4.

As seen from the figure, the straight line (c) moves parallel with respect to the straight line (b) to the vicinity of the ideal straight line (a). The overall offset is reduced by exactly an amount Va.

Note, even if the offset in the non-inverted period is eliminated, the offset Vb due to the gain difference remains in the inverted period.

Similarly, if the countermeasure against offset is carried out at only the time of inversion (at a point V2: for example 11V), the offset Vb' remains in the non-inverted period at this time. This is indicated by a straight line (d) in FIG. 3.

If the offsets are different between the inverted period and the non-inverted period like the characteristic lines (c) and (d), a difference appears in the output for every V cycle of the video signal when viewing one dot of the screen. This will be appear as a flicker.

A case where the countermeasure against offset by the comparison of the input and output according to the present invention is carried out at both of the time of non-inversion (at the point V1) and the time of inversion (at the point V2) is indicated by a straight line (e).

In this case, there is convergence to the point where the effect at the time of non-inversion and the effect at the time of inversion are balanced.

At this time, an offset Vc' at the point V1 and an offset Vc at the point V2 become almost equal, therefore the flicker disappears and the image quality is improved.

For this reason, the voltage comparison in the voltage/current conversion circuit GMA1 of the output level adjustment circuit 403 is carried out at both of the time of inversion and the time of non-inversion of the video signal VIN.

The timing control circuit 5A performs the timing control of the sampling time and holding time by the on/off control of the switch circuits SW1 and SW2 of the first and second sample-and-hold circuits 401-1 and 401-2 of the output blocks 40-1, 40-2, and 40-3 of the data line drive circuit 4A and the timing control of the voltage comparison by the on/off control of the switch circuit SW3 of the voltage/current conversion circuit GMA1 of the output level adjustment circuit 403 in a period when the video data for the switching of the horizontal synchronization signal (H) of video signal does not exist by a timing control signal CTL51A.

The timing control circuit 5A supplies the control signals CP1-1, CP1-2, and CP1-3 to the output blocks 40-1, 40-2, and 40-3 so that the on/off control of the switch circuit SW1 of the first sample-and-hold circuit 401-1 is not carried out simultaneously for the output blocks 40-1, 40-2, and 40-3, but is sequentially carried out.

Next, at the timing the same as that of the supply of the control signal CP1-3 to the output block 40-3, the control signal CP2 is supplied to the switch circuit SW2 of the second sample-and-hold circuit 401-2 of the output blocks 40-1 to 40-3 at the same timing.

Then, the control signal CP3 for turning on the switch circuit SW3 of the voltage/current conversion circuit GMA1 is supplied to the output blocks 40-1 to 40-3 at the same timing.

FIGS. 5A to 5F are timing charts of an example of the timing of supply of the control signals CP1 (−1 to −3) of the timing control circuit 5A.

In order to compare the voltage between the input and output in the circuit containing the sample-and-hold circuit, it is necessary to continuously apply a constant voltage to the input for exactly a certain time T.

In the case of the example of FIG. 5, the time T must have a format containing T1+T2.

Here, T1 is a time until the video signal VIN passes through the first and second sample-and-hold circuits 401-1 and 401-2 and output from the drive circuit 402 as the signal of the voltage VOUT. If this time T1 is not provided, two signals to be compared are not prepared. Accordingly, it is the time which must be certainly prepared before starting the comparison.

Further, a time T2 is a time for comparing the video signal VIN and the resistance-divided voltage VOUT' and charging the (or discharging) the capacitor C3.

It is necessary to prepare a constant voltage for exactly this time T somewhere in the video signal. Since there is an unused part in the switching time of the horizontal synchronization signal (H), it can be sufficiently placed there.

Note that the time T2 does not have to be a time for completely charging the capacitor C3 at one time. This periodically comes at every switching of the horizontal synchronization signal (H) of the video signal VIN, therefore this may be a time with which the charging can be gradually carried out.

Next, an explanation will be made of the operation by the above configuration.

First, a voltage V1 for comparison is input to the input terminal TIN by using the unused part of the switching period of the horizontal synchronization signal (H) of the video signal VIN. This voltage V1 is input to the input terminal TIN while holding the constant level for a while.

The voltage V1 is input to the output blocks 40-1 to 40-3, passes through the on/off operation of the switch circuits SW1 and SW2 of the first and second sample-and-hold circuits 401-1 and 401-2 controlled in on/off state by the control signals CP1 and CP2 of the timing control circuit 5A, becomes the voltage V1', and is input to the non-inverting input (+) of the drive circuit 402.

Note that, here, the reason why the voltage V1 changes to the voltage V1' is the influence of the droop etc. generated by the sample-and-hold operation.

Then, the voltage V1' becomes a voltage V1" (VOUT') from the relationship such as $((R1+R2)/R1)\times(R3/(R3+R4))=1$ and is input to the non-inverting input terminal (+) of the voltage/current conversion circuit GMA1.

Note that the reason why the voltage V1' changes to V1" is the influence of the offset generated by the drive circuit 402.

Next, by the control signal CP3 of the timing control circuit 5A, the switch circuit SW3 of the voltage/current conversion circuit GMA1 is switched to the on state.

At this time, the input voltage V1 is supplied to the inverting input terminal (−) of the voltage/current conversion circuit GMA1.

Accordingly, in the voltage/current conversion circuit GMA1, the input voltage V1 and the feedback voltage V1" are compared and the difference of the two voltages is output as the current and converted to voltage at the capacitor C3. The voltage of the node N3 passes through the buffer circuit BUF3 and is supplied to the inverting input terminal (−) side of the drive circuit 402 in the direction cancelling the difference of VIN and VOUT'.

For example, if V1<V1", a voltage of the + direction is supplied to the resistor element R1, and the output voltage VOUT of the drive circuit 402 tends to fall.

Next, by the control signal CP3 of the timing control circuit 5A, the switch circuit SW3 of the voltage/current conversion circuit GMA1 is switched to the off state, and the comparison operation is stopped.

As a result, the input terminal TIN is freed from the input of the voltage V1, and the video signal enters. The voltage of the resistor element R1 is held during this time.

Then, the video signal is ended, and the switching of the horizontal synchronization signal (H) starts.

The above operation is repeatedly carried out. Stabilization is achieved at a point where V1 becomes equal to V1". For this reason, a signal with little offset with respect to the input video signal VIN is obtained in the output voltage VOUT of the drive circuit 402.

In actuality, the offset voltage can be suppressed to about +5 mV by the offset of the voltage/current conversion circuit GMA1.

Figure 6A:
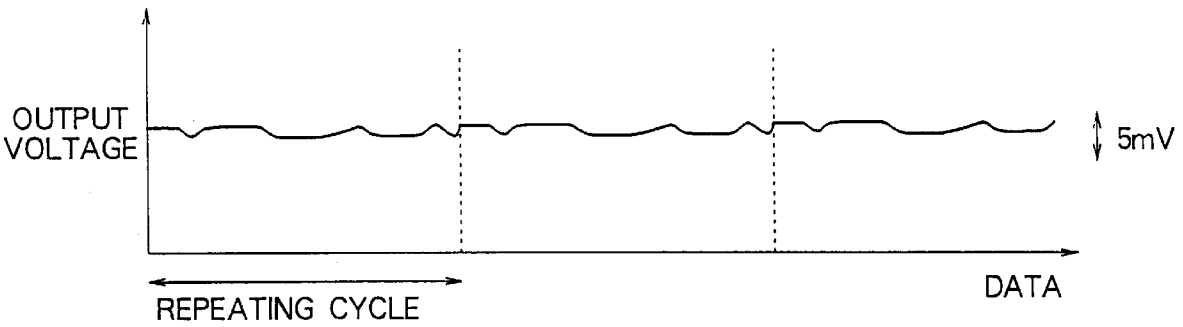
FIGS. 6A and 6B are views of examples of output waveforms where the data line drive circuit is integrated according to the present invention is integrated.
Figure 6B:
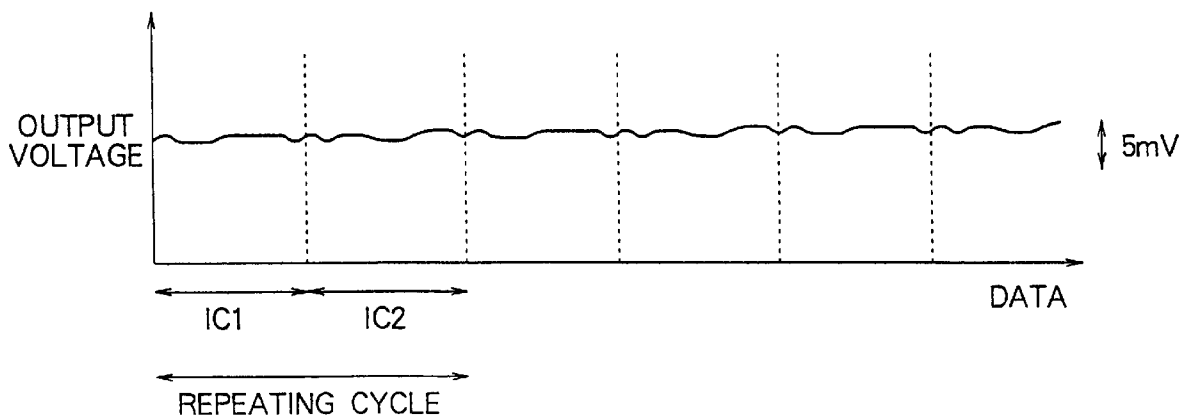
Figure 7:
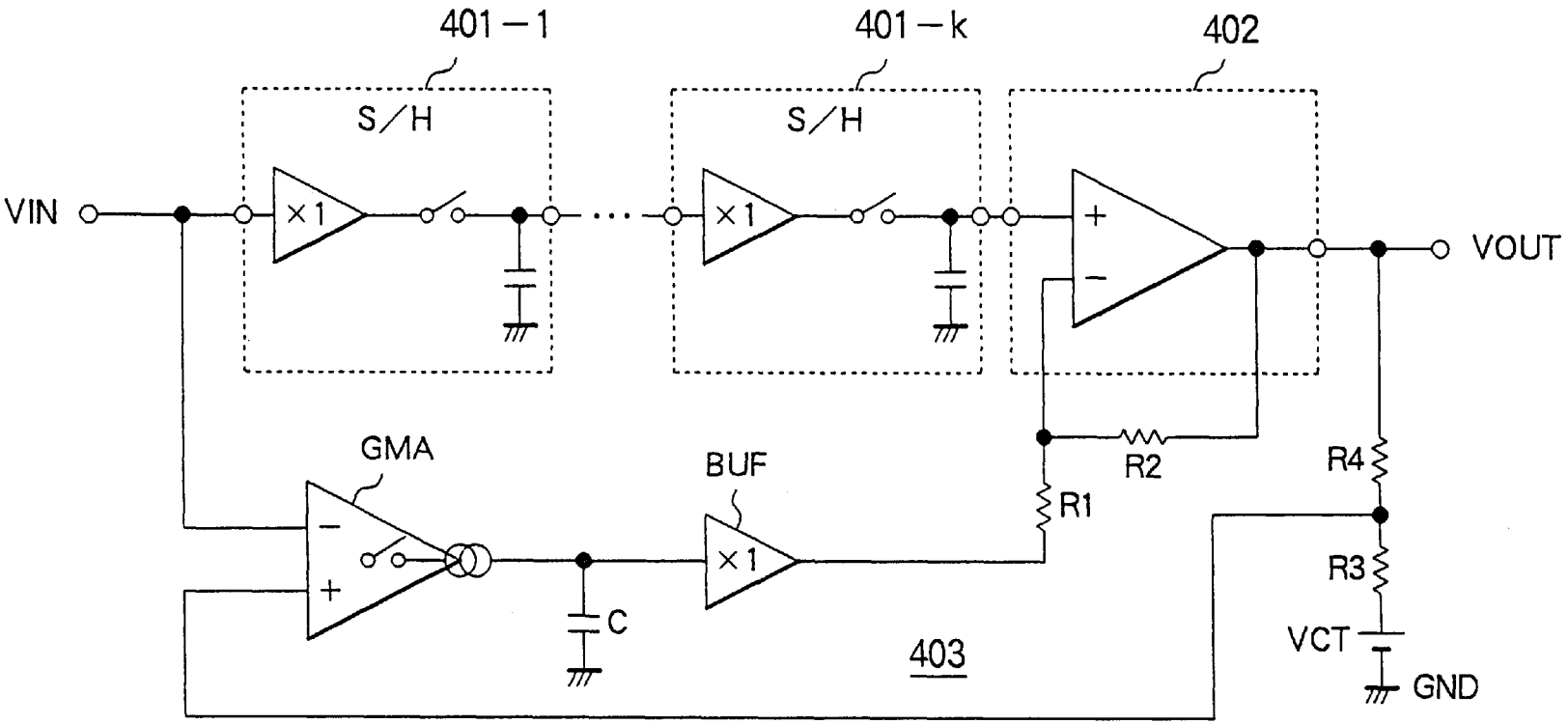
FIG. 7 is a circuit diagram of a data line drive circuit according to another embodiment of the present invention.

The output waveforms at this time are shown in FIG. 6A and FIG. 6B.

Figure 10A:
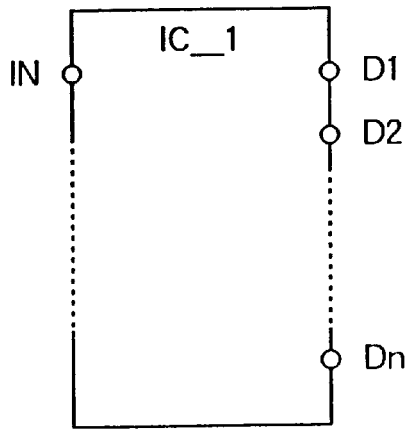
PRIOR ART FIG. 10A
FIGS. 10A and 10B are views of examples of configurations of integration of the data line drive circuit.
Figure 10B:
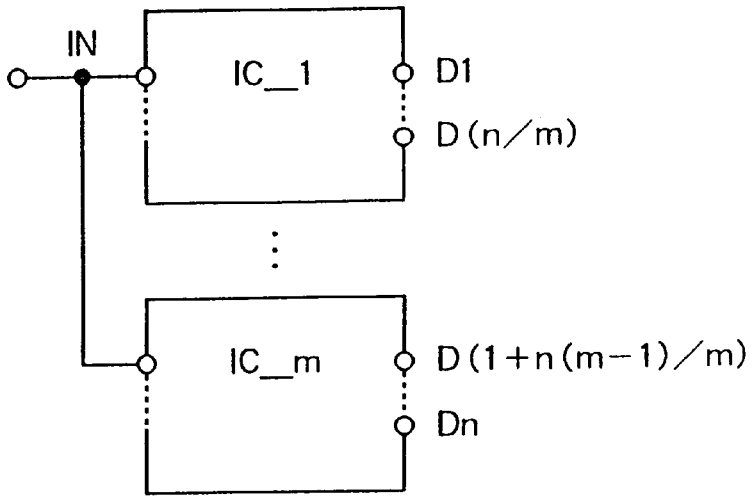
PRIOR ART FIG. 10B
Figure 11A:
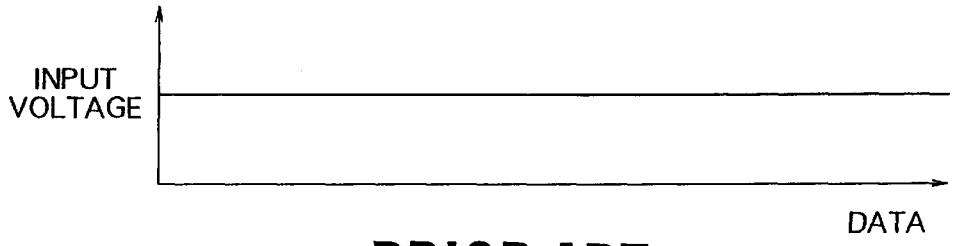
PRIOR ART FIG. 11A
FIGS. 11A and 11D are views of examples of ideal input/output and actual output waveforms of a circuit of the related art where the data line drive circuit is integrated.
Figure 11B:
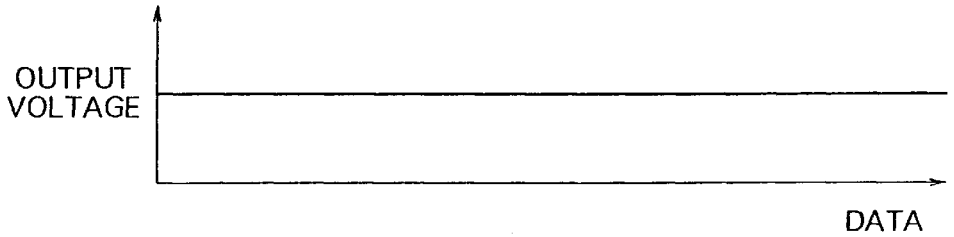
PRIOR ART FIG. 11B
Figure 11C:
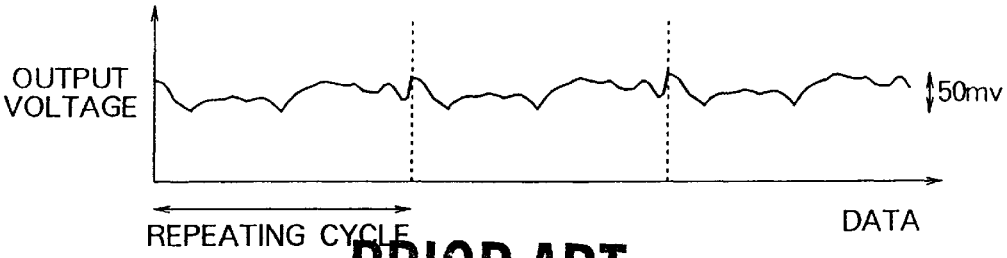
PRIOR ART FIG. 11C
Figure 11D:
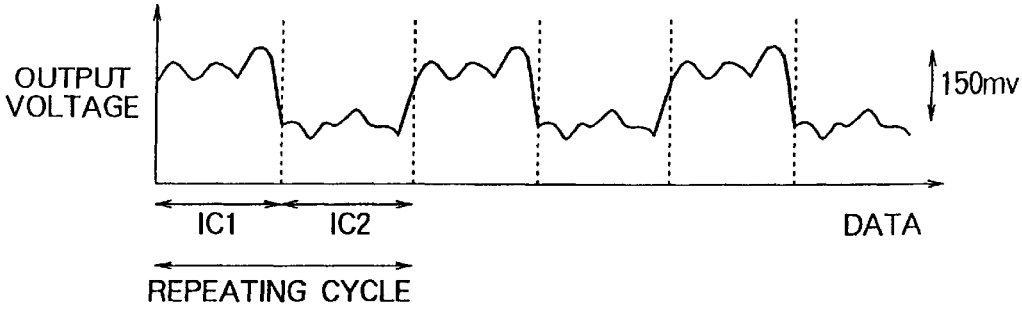
PRIOR ART FIG. 11D

Note that, FIG. 6A shows the output by one IC as in FIG. 10A; and FIG. 6B shows the output by a plurality of IC's as in FIG. 10B (note, in FIG. 6B, m=2 as in FIG. 10B).

Here, the offset of the voltage/current conversion circuit GMA1 is generated due to the relative characteristic difference of differential transistors and is not due to the absolute characteristic.

For this reason, the offset difference among IC's is never larger than the offset difference among outputs inside an IC, therefore the output waveforms shown in FIG. 6A and FIG. 6B are almost the same.

As described above, according to the present embodiment, there is provided a data line drive circuit 4A of a liquid crystal display device for driving a plurality of data lines to which pixel switches are connected in parallel in accordance with an input video signal, wherein provision is made of a plurality of output blocks 40-1 to 40-n provided with the sample-and-hold circuits 401-1 and 401-2 connected in series for sampling the input video signal and holding the sampled data for a constant period, the drive circuit 402 for outputting the held data of the sample-and-hold circuit 401-2 as a signal of a predetermined level, and the output level adjustment circuit 403 for comparing the voltages V1 and V2 provided in the switching period of the horizontal synchronization signals in the input video signal and the output signal voltage VOUT of the drive circuit 402 and adjusting the level of the output signal of the drive circuit to a constant level, wherein the input terminals TIN1 to TINn of the output blocks 40-1 to 40-n are connected to the input terminal TIN of the video signal in parallel, and the output terminals TOUT1 to TOUTn are connected to the different data lines to be driven. Therefore, the offset of output can be corrected by a comparison of the input and output signals and a difference of offsets among a plurality of outputs can be suppressed.

Accordingly, even if this data line drive circuit 4A is used in a high gradation liquid crystal display, no repeating pattern of vertical stripes will be generated on the screen. Further, there is the advantage that flicker can also be reduced.

Note that, in the present embodiment, the explanation was made by taking a case where two sample-and-hold circuits in output blocks were connected in series, but needless to say that the present invention can be applied to a circuit in which any number k of sample-and-hold circuits are connected in series.

While the invention has been described with reference to specific embodiments chosen for purposes of illustration, it should be apparent that numerous modifications could be made thereto by those skilled in the art without departing from the basic concept and scope of the invention.

What is claimed is:

1. A data line drive circuit of a liquid crystal display for driving a data line to which a pixel switch is connected in accordance with an input video signal, comprising:

a sample-and-hold circuit for sampling the input video signal and holding the sampled data for a constant period;

a drive circuit for outputting the held data of said sample-and-hold circuit as a signal of a predetermined level; and an output level adjustment circuit for comparing a voltage of a predetermined period in the input video signal with an output signal voltage of said drive circuit and adjusting the level of the output signal of the drive circuit to a constant level.

2. A data line drive circuit of a liquid crystal display according to claim 1, wherein:

a comparison use voltage is set in a predetermined period except a video data period for said video signal; and said output level adjustment circuit compares said comparison use voltage and the voltage level of the output signal of said drive circuit.

3. A data line drive circuit of a liquid crystal display according to claim 2, wherein:

the predetermined period except said video data period is a predetermined period within a switching period of a horizontal synchronization signal of the video signal.

4. A data line drive circuit of a liquid crystal display according to claim 3, wherein:

said video signal is repeatedly inverted and non-inverted for every switching of the horizontal synchronization signal, and a first comparison use voltage and a second comparison use voltage are set in the switching period of both horizontal synchronization signals of the inverted period and non-inverted period.

5. A data line drive circuit of a liquid crystal display for driving a plurality of data lines to which pixel switches are connected in parallel in accordance with an input video signal, comprising a plurality of output blocks provided with:

at least one sample-and-hold circuit for sampling the input video signal and holding the sampled data for a predetermined period, a drive circuit for outputting the held data of said sample-and-hold circuit as a signal of a predetermined level, and an output level adjustment circuit for comparing a voltage of a predetermined period in the input video signal with an output signal voltage of said drive circuit and adjusting the level of the output signal of the drive circuit to a constant level, the input terminals of output blocks being connected in parallel to an input terminal of the video signal, and the output terminals being connected to different data lines to be driven.

6. A data line drive circuit of a liquid crystal display according to claim 5, wherein:

a comparison use voltage is set in a predetermined period except the video data period for said video signal; and said output level adjustment circuit of each said output block compares said comparison use voltage and the voltage level of the output signal of said drive circuit.

7. A data line drive circuit of a liquid crystal display according to claim 6, wherein:

the predetermined period except said video data period is a predetermined period within the switching period of the horizontal synchronization signal of the video signal.

8. A data line drive circuit of a liquid crystal display according to claim 7, wherein:

said video signal is repeatedly inverted and non-inverted for every switching of the horizontal synchronization signal, and a first comparison use voltage and a second comparison use voltage are set in a switching period of both horizontal synchronization signals of the inverted period and non-inverted period.

9. A data line drive circuit of a liquid crystal display according to claim 5, further comprising:

a control circuit for controlling a sample-and-hold timing of the sample-and-hold circuit and a comparison operation timing of the output level adjustment circuit of each said output block.

10. A data line drive circuit of a liquid crystal display according to claim 8, further comprising:

a control circuit for controlling a sample-and-hold timing of the sample-and-hold circuit and a comparison operation timing of the output level adjustment circuit of each said output block.

11. A liquid crystal display having a data line drive circuit for driving a data line to which a pixel switch is connected in accordance with an input video signal, comprising:

a sample-and-hold circuit for sampling the input video signal and holding the sampled data for a constant period;

a drive circuit for outputting the held data of said sample-and-hold circuit as a signal of a predetermined level; and an output level adjustment circuit for comparing a voltage of a predetermined period in the input video signal with the output signal voltage of said drive circuit and adjusting the level of the output signal of the drive circuit to a constant level.

12. A liquid crystal display according to claim 11, wherein:

a comparison use voltage is set in a predetermined period except a video data period for said video signal; and said output level adjustment circuit compares said comparison use voltage and the voltage level of the output signal of said drive circuit.

13. A liquid crystal display according to claim 12, wherein:

the predetermined period except said video data period is a predetermined period within a switching period of a horizontal synchronization signal of the video signal.

14. A liquid crystal display according to claim 13, wherein:

said video signal is repeatedly inverted and non-inverted for every switching of the horizontal synchronization signal, and a first comparison use voltage and a second comparison use voltage are set in the switching period of both horizontal synchronization signals of the inverted period and non-inverted period.

15. A liquid crystal display having a data line drive circuit for driving a plurality of data lines to which pixel switches are connected in parallel in accordance with an input video signal, comprising a plurality of output blocks provided with:

at least one sample-and-hold circuit for sampling the input video signal and holding the sampled data for a predetermined period, a drive circuit for outputting the held data of said sample-and-hold circuit as a signal of a predetermined level, and an output level adjustment circuit for comparing a voltage of a predetermined period in the input video signal with an output signal voltage of said drive circuit and adjusting the level of the output signal of the drive circuit to a constant level, the input terminals of output blocks being connected in parallel to an input terminal of the video signal, and the output terminals being connected to different data lines to be driven.

16. A liquid crystal display according to claim 15, wherein:

a comparison use voltage is set in a predetermined period other than the video data period for said video signal; and said output level adjustment circuit of each said output block compares said comparison use voltage and the voltage level of the output signal of said drive circuit.

17. A liquid crystal display according to claim 16, wherein:

the predetermined period except said video data period is a predetermined period within the switching period of the horizontal synchronization signal of the video signal.

18. A liquid crystal display according to claim 17, wherein:

said video signal is repeatedly inverted and non-inverted for every switching of the horizontal synchronization signal, and a first comparison use voltage and a second comparison use voltage are set in a switching period of both horizontal synchronization signals of the inverted period and non-inverted period.

19. A liquid crystal display according to claim 15, further comprising:

a control circuit for controlling a sample-and-hold timing of the sample-and-hold circuit and a comparison operation timing of the output level adjustment circuit of each said output block.

20. A liquid crystal display according to claim 18, further comprising:

a control circuit for controlling a sampleand-hold timing of the sample-and-hold circuit and a comparison operation timing of the output level adjustment circuit of each said output block.

* * * * *